US006923332B1

(12) United States Patent
Thomas

(10) Patent No.: US 6,923,332 B1
(45) Date of Patent: Aug. 2, 2005

(54) NURSING BOTTLE WITH ELONGATED TUBE AND PIVOTABLE PACIFIER

(76) Inventor: Jeff H. Thomas, 1157 Manatee Dr., Rockledge, FL (US) 32955

( * ) Notice: Subject to any disclaimer, the term of this patent is extended or adjusted under 35 U.S.C. 154(b) by 0 days.

(21) Appl. No.: 10/342,428

(22) Filed: Jan. 13, 2003

(51) Int. Cl.[7] ..... A61J 9/00; A61J 9/06; A61J 11/00; A61J 11/04

(52) U.S. Cl. ..... 215/11.1; 215/11.6; 215/388; 248/102; 248/104; 606/236

(58) Field of Search ..... 215/11.1, 11.3, 215/386, 388; 248/102, 104, 106; 606/236; 220/705

(56) References Cited

U.S. PATENT DOCUMENTS

| | | | | | |
|---|---|---|---|---|---|
| 154,562 | A | | 9/1874 | Perkins | |
| 224,557 | A | * | 2/1880 | Potter | 215/11.1 |
| 253,014 | A | * | 1/1882 | Day | 215/11.1 |
| 280,656 | A | * | 7/1883 | Morris | 215/11.1 |
| 1,913,531 | A | * | 6/1933 | Block | 215/11.1 |
| 1,947,753 | A | * | 2/1934 | Block | 215/11.1 |
| 2,558,195 | A | | 6/1951 | Pearl | 215/11 |
| 2,624,485 | A | * | 1/1953 | Boston | 215/11.5 |
| 2,760,664 | A | * | 8/1956 | D'Amico et al. | 215/11.1 |
| 2,812,764 | A | * | 11/1957 | Crisp | 215/11.1 |
| 2,932,476 | A | * | 4/1960 | Neibel et al. | 248/106 |
| 4,301,934 | A | | 11/1981 | Forestal | 215/11 D |
| 4,405,106 | A | * | 9/1983 | Adler | 248/102 |
| 4,463,859 | A | * | 8/1984 | Greene | 215/11.1 |
| 4,485,963 | A | * | 12/1984 | Panicci | 229/103.1 |
| 4,726,551 | A | * | 2/1988 | Randall et al. | 248/102 |
| 4,796,628 | A | | 1/1989 | Anderson | 128/360 |
| 4,898,290 | A | | 2/1990 | Cueto | 215/11.1 |
| 4,925,042 | A | * | 5/1990 | Chong | 215/11.1 |
| 4,994,076 | A | | 2/1991 | Guss | 215/11.1 |
| 5,040,756 | A | | 8/1991 | Via Cava | 248/103 |
| 5,049,127 | A | * | 9/1991 | Yen Tseng | 604/79 |
| 5,105,956 | A | * | 4/1992 | Tarng-Lin | 215/11.1 |
| 5,190,174 | A | * | 3/1993 | Klag | 215/11.1 |
| 5,421,496 | A | | 6/1995 | Korsinsky et al. | 224/148 |
| 5,551,583 | A | * | 9/1996 | Sachathamakul et al. | 215/386 |
| 5,573,507 | A | * | 11/1996 | Moser et al. | 604/77 |
| 5,678,709 | A | * | 10/1997 | Holley et al. | 215/11.4 |

(Continued)

FOREIGN PATENT DOCUMENTS

| | | | | |
|---|---|---|---|---|
| EP | 006303 | A2 * | 10/1982 | 215/11.1 |

*Primary Examiner*—Sue A. Weaver
(74) *Attorney, Agent, or Firm*—Thomas C. Saitta

(57) ABSTRACT

A baby bottle feeding apparatus and method for assisting the feeding of a nursing infant by a bottle attached to an elongated feeding tube with pacifier end. The apparatus and method can include a pivotable connector such as a ball and socket connected between an elongated tube and the pacifier that can be rotated to selected positions without pinching off the tube for allowing ease of use by the nursing infant. The apparatus and methods can include additional assists such as allowing the liquid contents of the bottle to become more easily moveable by gravity flow. One embodiment can have a stand that orients the bottle up to approximately ninety degrees which can include forty five degrees when positioning the bottle on a support surface. Another embodiment allows for an interior wall inside the bottle to have a sloped portion so that laying the bottle on its side in a horizontal position still allows gravity to assist moving liquid contents within the bottle to the feeding infant.

14 Claims, 9 Drawing Sheets

U.S. PATENT DOCUMENTS 5,772,685 A 6/1998 Crowe et al. ..... 606/236
5,918,838 A * 7/1999 Strandberg ..... 248/106
5,938,053 A * 8/1999 Verbovszky et al. ..... 215/6
6,033,367 A 3/2000 Goldfield ..... 600/529
6,098,934 A * 8/2000 Skelton ..... 248/102
6,139,566 A 10/2000 Bennett ..... 606/236
6,250,487 B1 * 6/2001 Tebeau ..... 215/11.1
6,253,936 B1 * 7/2001 Kong ..... 215/11.3

* cited by examiner

NURSING BOTTLE WITH ELONGATED TUBE AND PIVOTABLE PACIFIER

This invention relates to nursing bottles, in particular to a novel baby bottle with an elongated feeding tube with pivotable pacifier where the contents of the bottle can be tilted for allowing gravity to assist a feeding infant.

BACKGROUND AND PRIOR ART

Basic nursing bottles have generally required a cylindrical bottle full of a feeding fluid with a pacifier directly attached thereon. Nursing a baby from a bottle has included many problems. Unless a proper orientation of the bottle is maintained, the infant is not properly fed, and often the infant starts to cry aloud until a parent or other caregiver to hold the bottle up to the infant.

Alternatively, the bottle must be propped up by blankets or any other crib accessories such as stuffed toys and/or stuffed animals. More often than not the baby must maintain a proper orientation of the bottle in order for it to be used.

In order to maintain the proper orientation, parents and caregivers try to allow the infant to directly hold the bottle. However, most newborns do not have the strength to support the bottle itself. Even older infants can have trouble lifting a bottle full of feeding fluid and maintaining the bottle at a proper feeding orientation.

Even if the bottle is reoriented infants have been known to become so upset that they often refuse to begin nursing again, and instead continue to cry out loud.

Still furthermore, the current bottles do not allow for parents/caregivers to easily assist the feeding liquid that is being passed from the bottle to the infant.

Over the years many devices have been proposed for modifying infant feeding bottles. See for example, U.S. Pat. No. 154,562 to Perkins; U.S. Pat. No. 2,558,195 to Pearl; U.S. Pat. No. 4,301,934 to Forestal; U.S. Pat. No. 4,796,628 to Anderson; U.S. Pat. No. 4,898,290 to Cueto; U.S. Pat. No. 4,994,076 to Guss; U.S. Pat. No. 5,040,756 to Via Cava; U.S. Pat. No. 5,421,496 to Korsinsky et al.; U.S. Pat. No. 5,772,685 to Crowe et al.; U.S. Pat. No. 6,033,367 to Goldfield; U.S. Pat. No. 6,139,566 to Bennett; and U.S. Pat. No. 6,197,044 to Clayton.

Pearl '195, Crowe et al. '685, Bennett '044, and Clayton '044 describe modifying pacifiers on nursing bottles but do not overcome any of the problems presented above.

Perkins '562 describes using an elongated tube connected to a pacifier for creating a vent that does not solve the problems described above. Cueto '290 and Guss '076 each describe attaching elongated tubes to baby bottles that do not allow for any drainage of the bottle contents. Anderson '628(FIG. 4), Forestal '934, Via Cava '756 and Korsinsky '496(FIG. 3) each describe bottles with elongated tubes connected to bottles that require brackets attached to other supports so that the bottles be maintained in inverted upside down above the infant that is not an easy way of solving the above stated problems. While a bracket may help with some of the problems referenced above, the brackets and/or supports add further problems since the bottles and/or parts of the brackets/supports can fall onto and injure the infant below.

Still furthermore, all of these elongated tube devices would additionally require physically bending the tube in order for the pacifier to be used by an infant. A rigid tube would be difficult to bend, and even if bent can become pinched and further cut off feeding the contents to the feeding infant.

Goldfield '367 describes an elaborate bottle nursing system using transducers/sensors and computers for nursing bottles that fails to provide a simple and easily attachable solution for solving the above stated problems with the prior art.

Thus, the need exists for solutions to the above problems with the prior art.

SUMMARY OF THE INVENTION

The first objective of the present invention is to provide an easily attachable and simple apparatus and method for bottles that allows their contents to naturally feed to a nursing infant.

The second objective of the present invention is to provide an easily attachable and simple apparatus and method that eliminates physically supporting the bottle for infant feeding.

The third objective of the present invention is to provide an easily attachable and simple apparatus and method for bottles that eliminates artificially propping up the bottle for infants.

The fourth objective of the present invention is to provide an easily attachable and simple apparatus and method for bottles that eliminates raising the bottle above a feeding infant.

The fifth objective of this invention is to provide an easily attachable and simple apparatus and method for bottles that eliminates using brackets/supports above a feeding infant.

The sixth objective of the present invention is to provide an easily attachable and simple apparatus and method for bottles that eliminates the infant having to support the bottle.

The seventh object of the present invention is to provide an easily attachable and simple apparatus and method for.

Further objects and advantages of this invention will be apparent from the following detailed description of a presently preferred embodiment which is illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

First Preferred Embodiment

Figure 1:
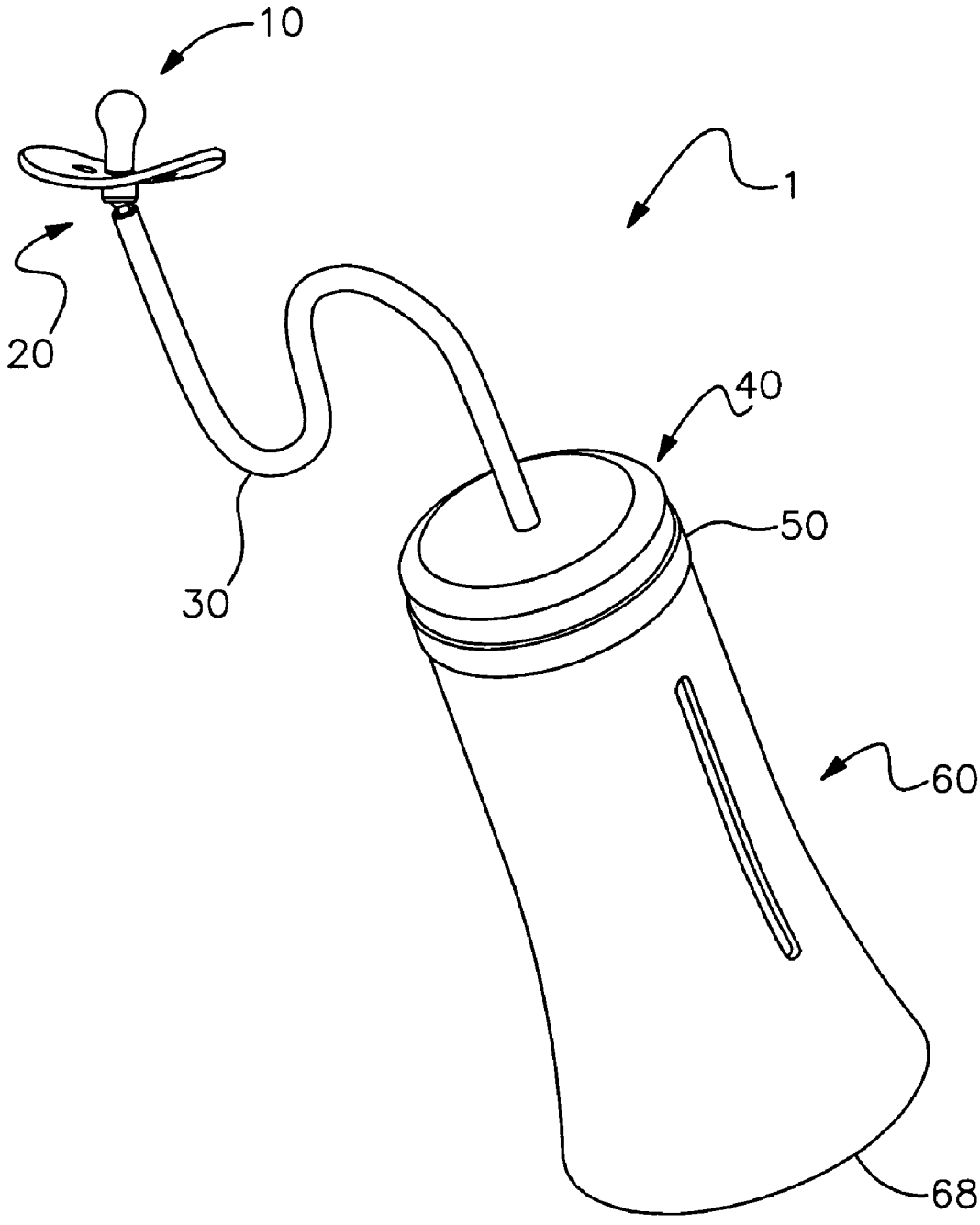
FIG. 1 is a perspective view of a first preferred nursing bottle embodiment with fluid bag having hand depressible end and elongated tube connector with swiveling pacifier end.
Figure 2:
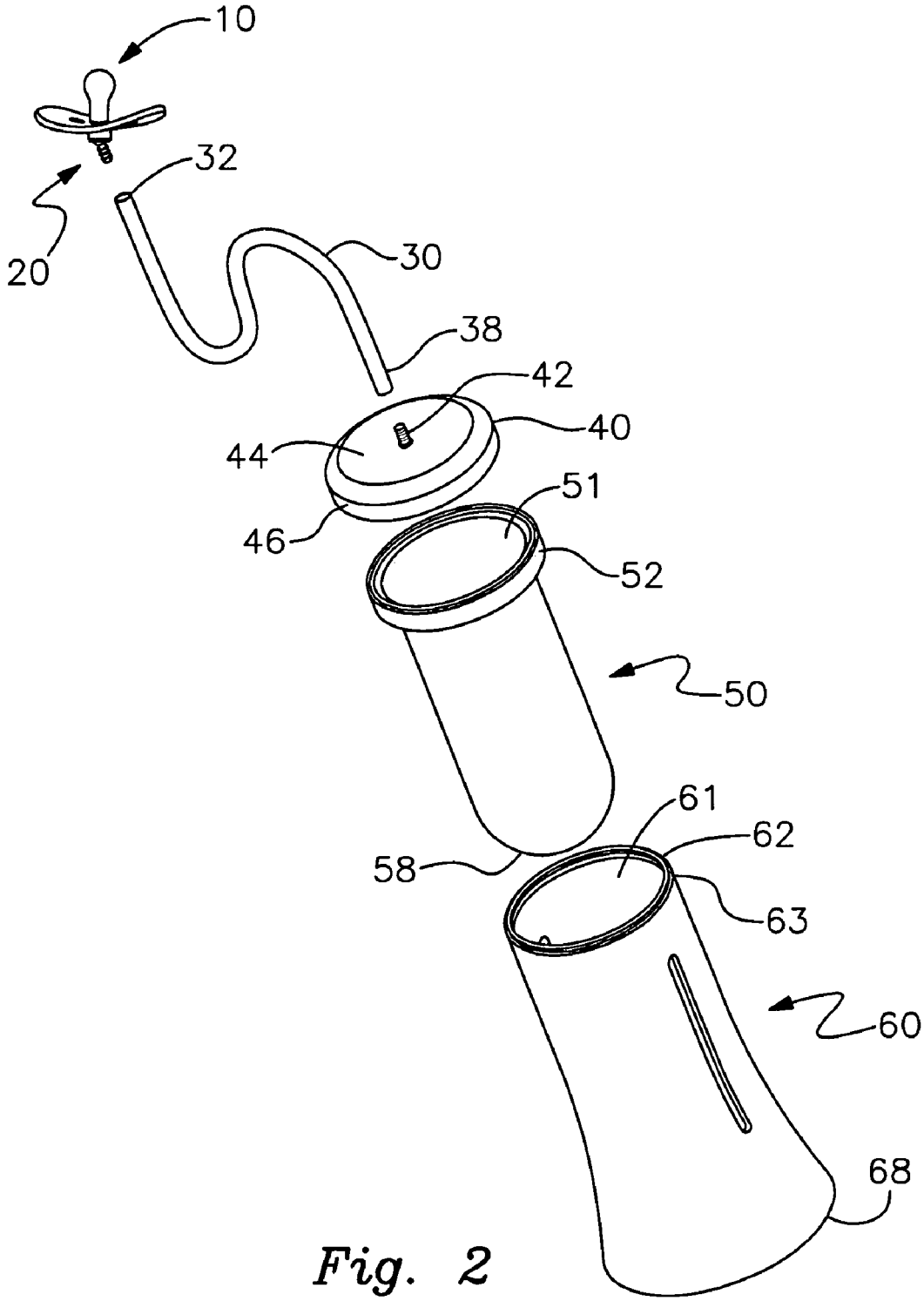
FIG. 2 is an exploded view of the embodiment of FIG. 1.
Figure 4:
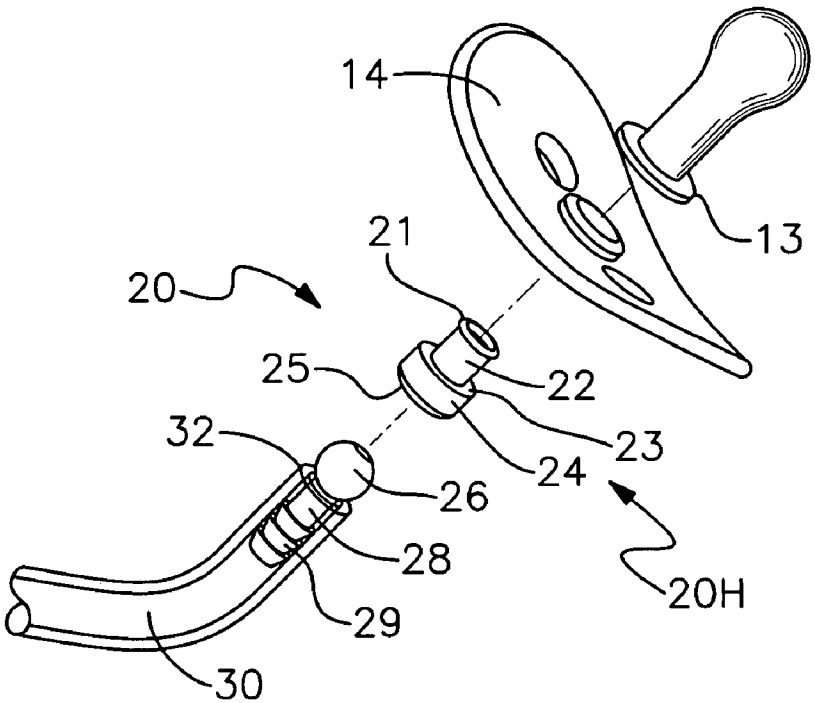
FIG. 4 is an exploded view of the swivable pacifier of FIG. 3.
Figure 3:
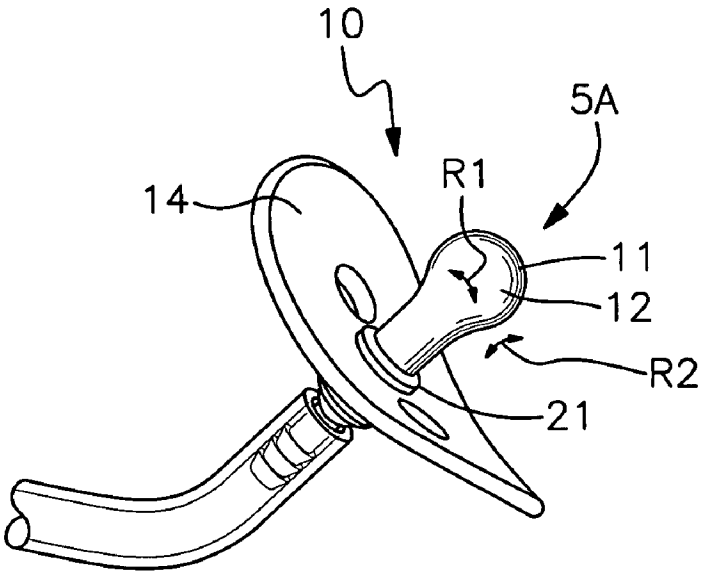
FIG. 3 is a perspective view of the swivable pacifier of FIG. 1.
Figure 6:
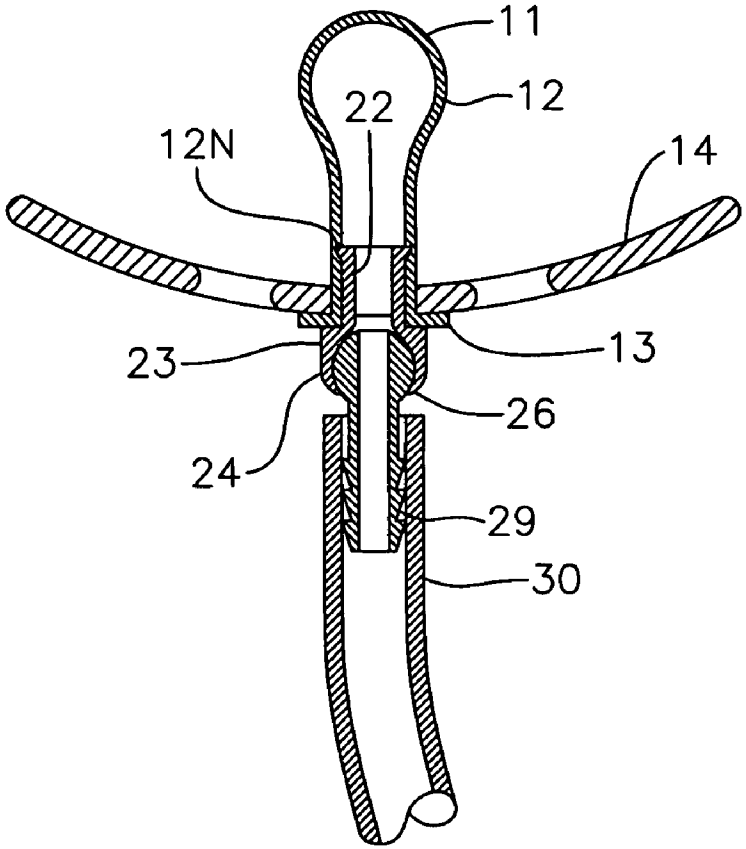
FIG. 6 is a cross-sectional view of the swivable pacifier of FIG. 5 along arrows 6X.
Figure 5:
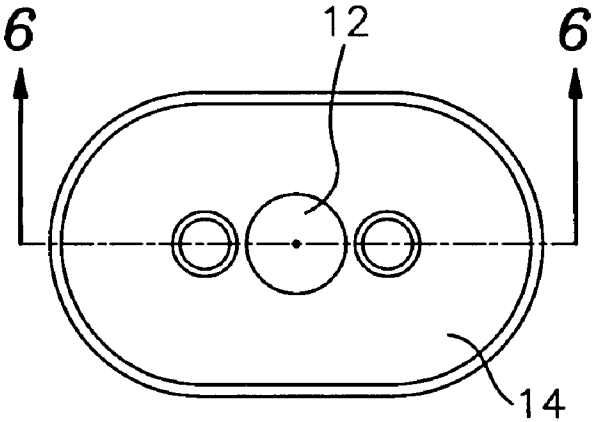
FIG. 5 is a top view of the swivable pacifier of FIG. 3 along arrow 5A.
Figure 8:
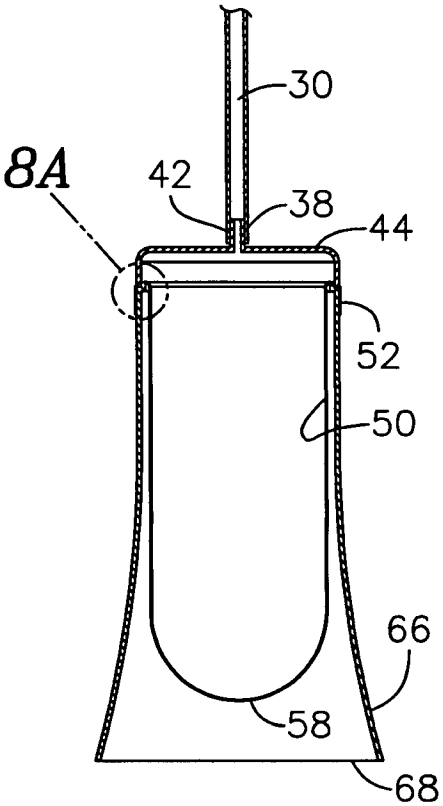
FIG. 8 is a cross-sectional view of the first embodiment of FIG. 7 along arrows 8X.
Figure 8A:
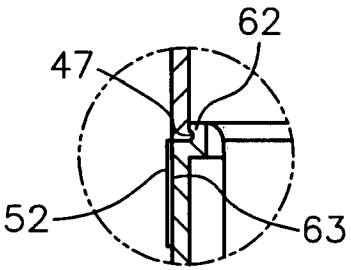
FIG. 8A is an enlarged cross-sectional view of the lid connected to the bottle.
Figure 7:
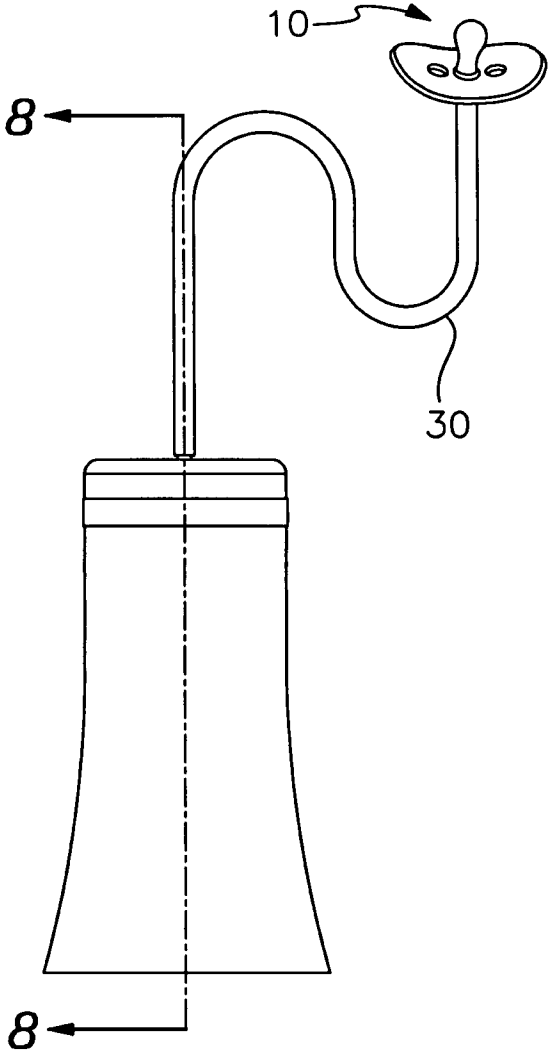
FIG. 7 is a side view of the first preferred embodiment of FIG. 1.

Referring to FIGS. 1–2, a pacifier 10 can be connected to an elongated flexible tube 30 by a swivable and/or pivotable joint member(s) 20. The other end of the tube 30 can be connected through a lid 40 to liquid contents such as formula, and the like, within a flexible bag 50 that is inside a generally cylindrical bottle 60. All of invention parts can be formed from injection molded plastic, and the like, with varying degrees of flexibility. The flexible tube 30 can be up to approximately 12 inches long or more, and be see-through so that the liquid contents can be inspected from outside. An opposite open end 68 of the bottle 60 can have flared side edges.

The pacifier 10 and the swivable and/or pivotable joint member(s) 20 will now be described. Referring to FIGS. 3, 4, 5 and 6, the pacifier 10 can include a bulbous nipple portion 12 having a slit 11 for allowing the feeding baby to extract liquid therethrough. A raised ring portion 13 can be positioned on the other side of a center aperture opening 12 in the flange guard 14 to hold the nipple 12 in place to one side of the guard 14. A ball and socket assembly 20 connects the pacifier 10 to one end of the elongated tube 30, and can include a hub member 20H having an upper raised ridge 21 of upper side walls 22 snugly and sealingly fit within the neck portion 12N of the nipple portion 12. A step-ledge portion 23 of the hub member 20H can abut against a lower surface of ring portion 13 of the pacifier 10. Within lower side walls 24 of hub member 20H can be curved rounded interior walls 25 which function as a socket for allowing a ball member 26 to pivotally rotate therein. A stem portion 28 extends down from the ball member 26 having angled ribs 29 that catch and tightly seal within one end 32 of the elongated tube 30. The pacifier 10 can rotate and pivot along various positions as depicted by double arrows R1 and R2. Thus, a feeding baby and/or caregiver can easily move the pacifier 10 relative to the elongated tube 30 without causing the tube 10 to become bent and pinched cutting off the fluid flow through the tube 30.

Referring to FIGS. 2, 7, 8 and 8A, the other end 38 of the flexible tube 30 can sealing and tightly fit about a raised ribbed hollow stem 42 of an upper surface portion 44 lid member 40. The sides 46 of the lid member 40 can have interior surfaces 47 that snap about a lip ledge portion 62 of the main bottle 60. Alternatively both the interior side wall surface portions 47 of the lid member 40 and the lip portion 62 of the bottle can have threads for allowing the lid member to screw onto the upper end 61 of the bottle 60. Inside the bottle 60 can be a flexible bag 50 such as a thin plastic, and/or elastomeric material, and the like. Bag 50 can have an upper open mouth portion end 51 and a closed bottom end 58. The upper end 51 of the bag can be folded outward 52 to overlap between the lid 40 and the upper outer edge 63 of the bottle so that connecting the lid 40 to the bottle 60 seals the mouth portion 51 of the bag therebetween. The bottom of the generally cylindrical bottle 60 can have an open end 68 which can have flared out side portions 66.

Figure 9:
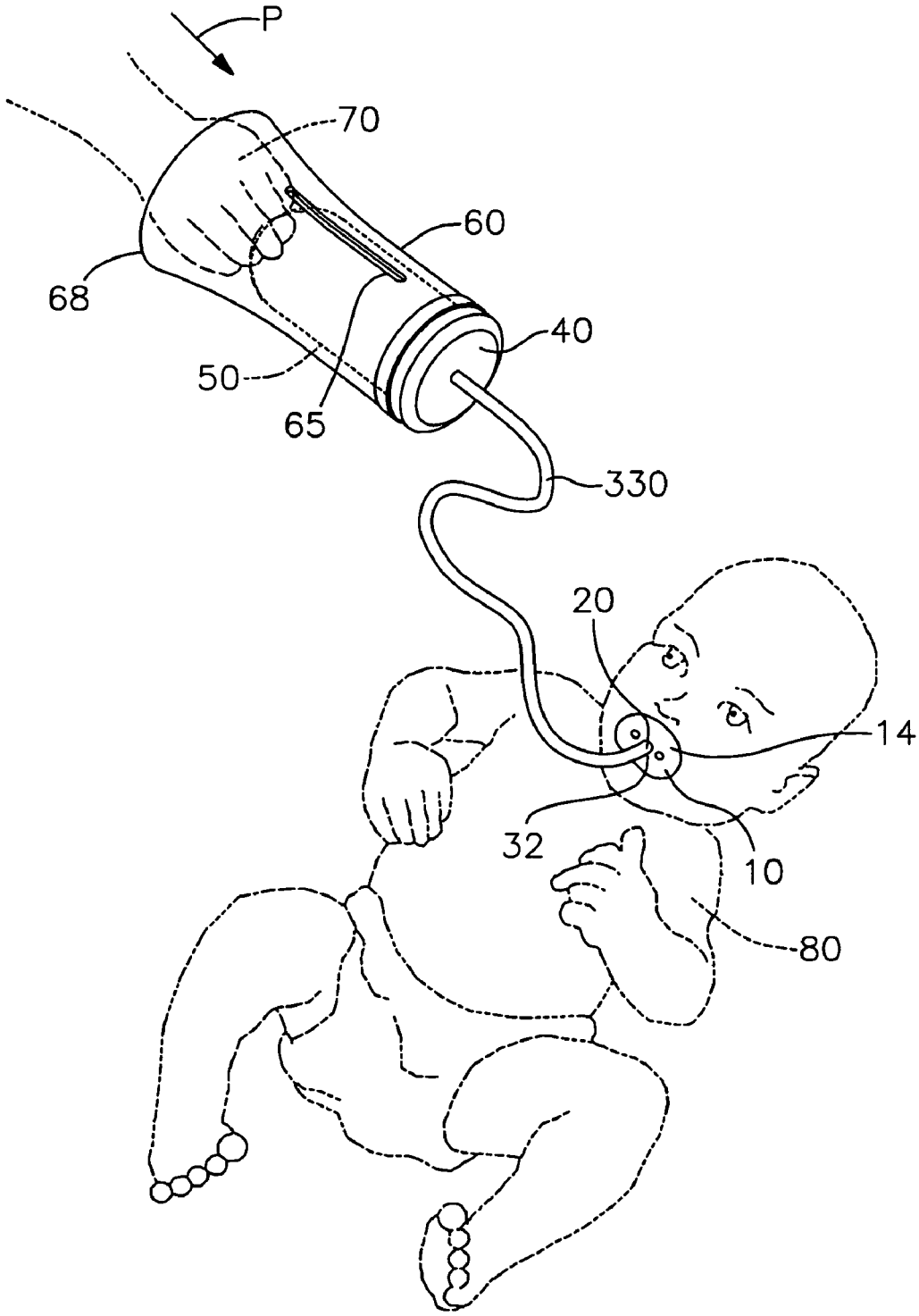
FIG. 9 illustrates an application of the first embodiment of the preceding figures with a nursing infant.

Referring to FIG. 9, a caregiver such as a parent and the like, can press a portion of their hand 70 through the open end 68 of the bottle depressing a portion of liquid filled bag 50 so that the liquid contents can more easily flow through the elongated tube 30 to the feeding infant 80 that is holding onto the pacifier 10. A side slit 65 in the bottle 60 can allow for the caregiver to see the amount of liquid contents within the bag 50 at anytime. Thus, the caregiver can provide for assisting the liquid content flow through the elongated tube 30. While FIG. 9 shows the upper end 32 of the elongated tube perpendicular to the flange guard 14 on the pacifier 10, the pivotable/swivable connector 20 can allow for the tube end 32 to be at varying angles to the pacifier eliminating any chances of the tube 30 becoming bent and pinched.

Second Embodiment

Figure 10:
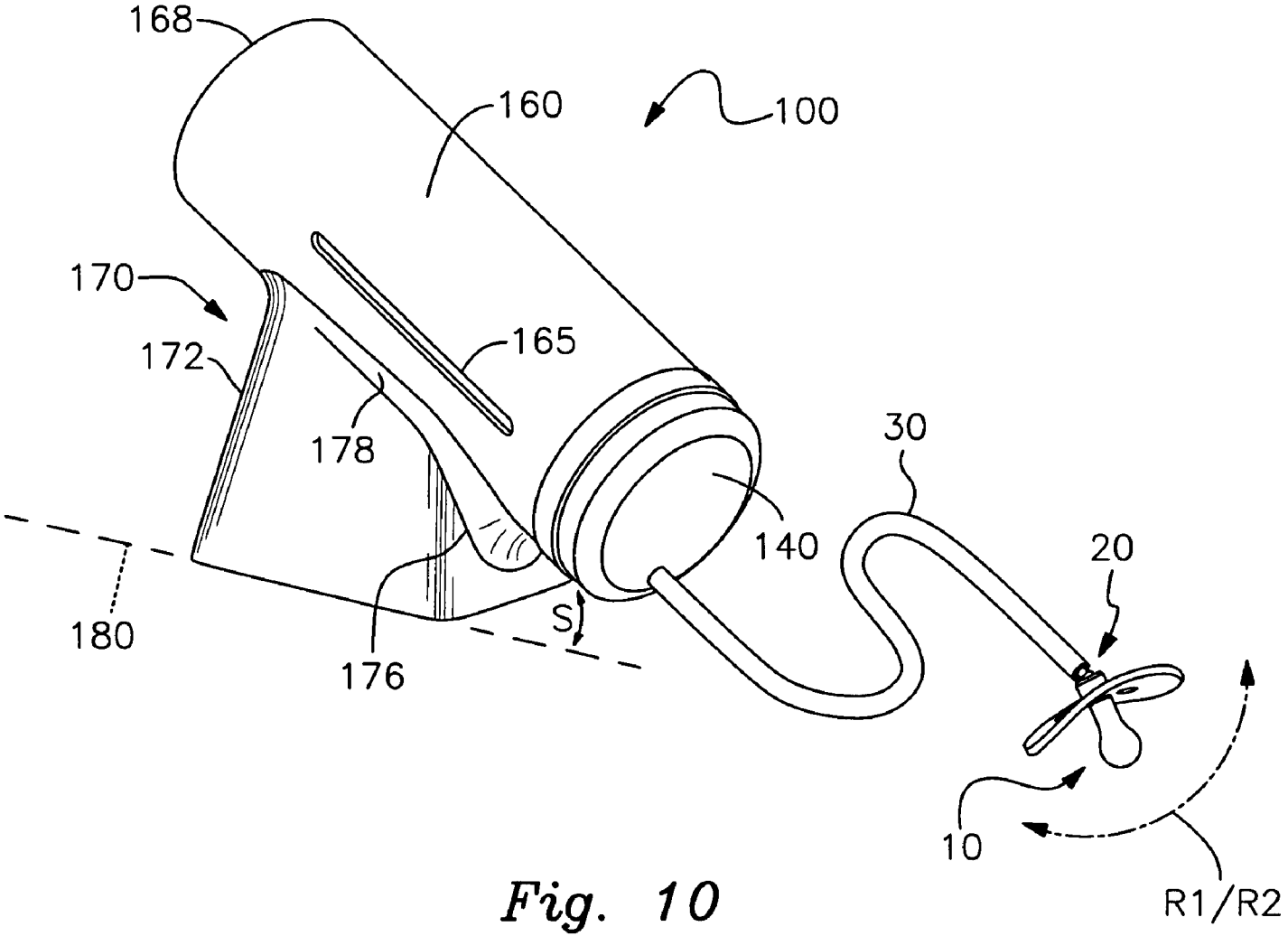
FIG. 10 is a perspective view of a second preferred nursing bottle embodiment with angled support stand and elongated tube connector with swiveling pacifier end.
Figure 11:
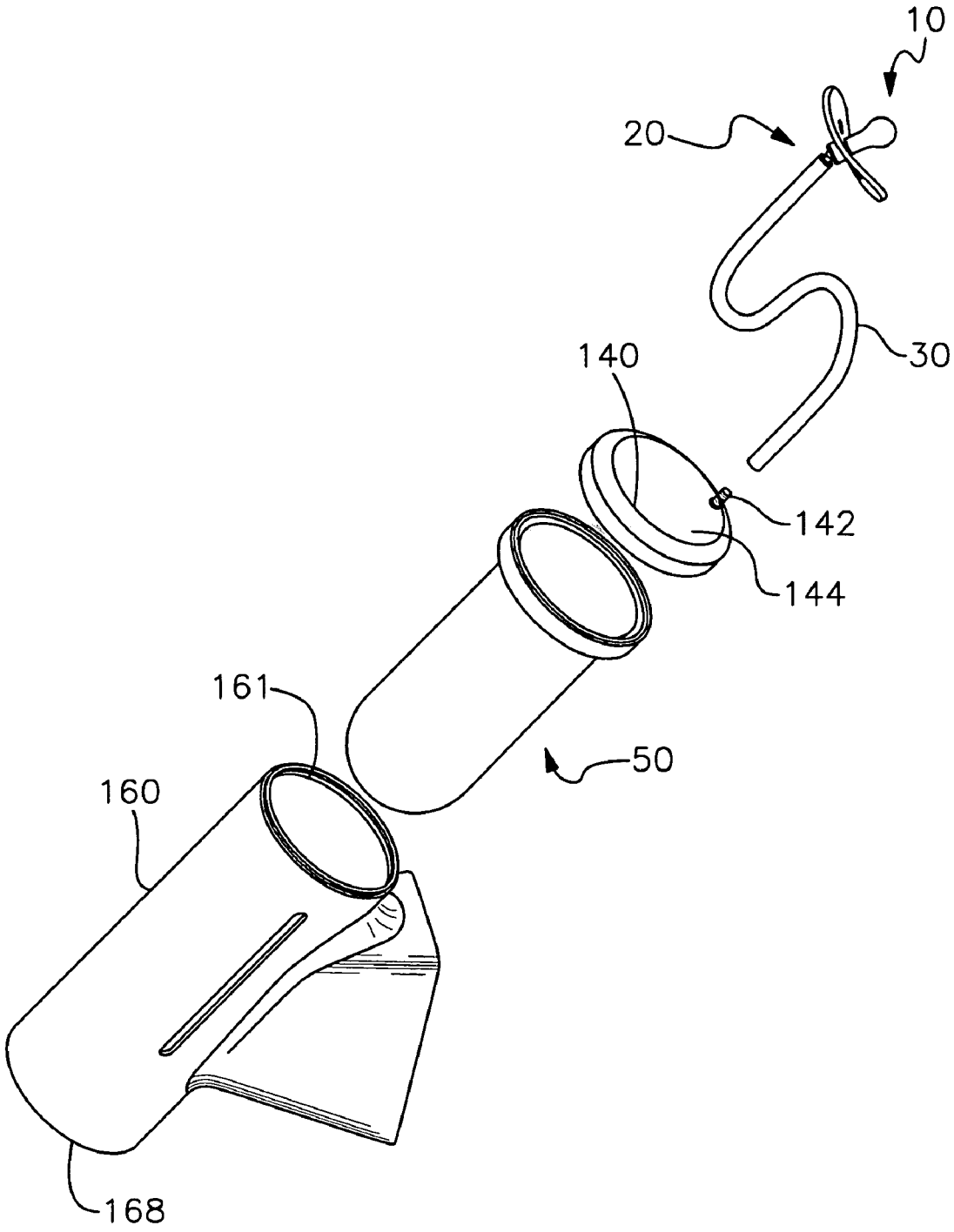
FIG. 11 is an exploded view of the second preferred embodiment of FIG. 10.

FIG. 10 is a perspective view of a second preferred nursing bottle embodiment 100 with angled support stand 170 and elongated tube connector 30 with swiveling pacifier end 10, 20. The support surface 180 can be a portion of a blanket on a mattress along side the feeding infant, a pillow, a table top, and the like. FIG. 11 is an exploded view of the second preferred embodiment 100 of FIG. 10.

Referring to FIGS. 10–11, second embodiment 100 can include identical pacifier 10, pivotable/swivable components 20, and elongated tube 30 that were used in the first embodiment. The lid 140 can be similar to the lid member 40 of the first embodiment, with the exception that the protruding hollow stem 142 is located along a lower surface portion of the outer lid surface 144. The flexible bag 50 for holding liquid feeding contents can be attached to the lid member 140 and to the mouth 161 of bottle 160 similar to the first embodiment. The bottle 160 can be similar to the bottle 60 of the first embodiment and include a see-through side slit opening 165 for allowing one to visually see the flexible bag 50 inside the bottle 160. The rear end 168 of the bottle can be closed. Alternatively, the rear end 168 can be open similar to that of the first embodiment for allowing one to press against the bag 50 for assisting the moving of the liquid from the bag 50 through the tube 30. The bottle 160 can be generally cylindrical. Alternatively, the rear end 168 of the bottle 160 can have a flared out sides similar to that of the first embodiment.

Referring to FIGS. 10–11, a stand 170 can be formed from materials such as but not limited to injection molded plastic and the like, and have a curved upper surface 178 for allowing for the bottle 160 to rest thereon. The bottle 160 and stand 170 can be premolded together, or be separate components that attach to one another. For example, fasteners such as double sided tape, hook and loop fasteners can be used to attach the bottle 160 to the stand 170. Stand 170 can have a back wall portion 172 having a greater height than a front wall portion 176 so that the bottle 160 can rest at an angle S of up to approximately ninety degrees, preferably 45 degrees. The sloped angle S of the bottle 160 and stand 170 resting on a generally horizontal support surface 180 allows for gravity to assist moving the liquid contents of the bag 50 through the tube 30 to a feeding infant.

Third Embodiment

Figure 12:
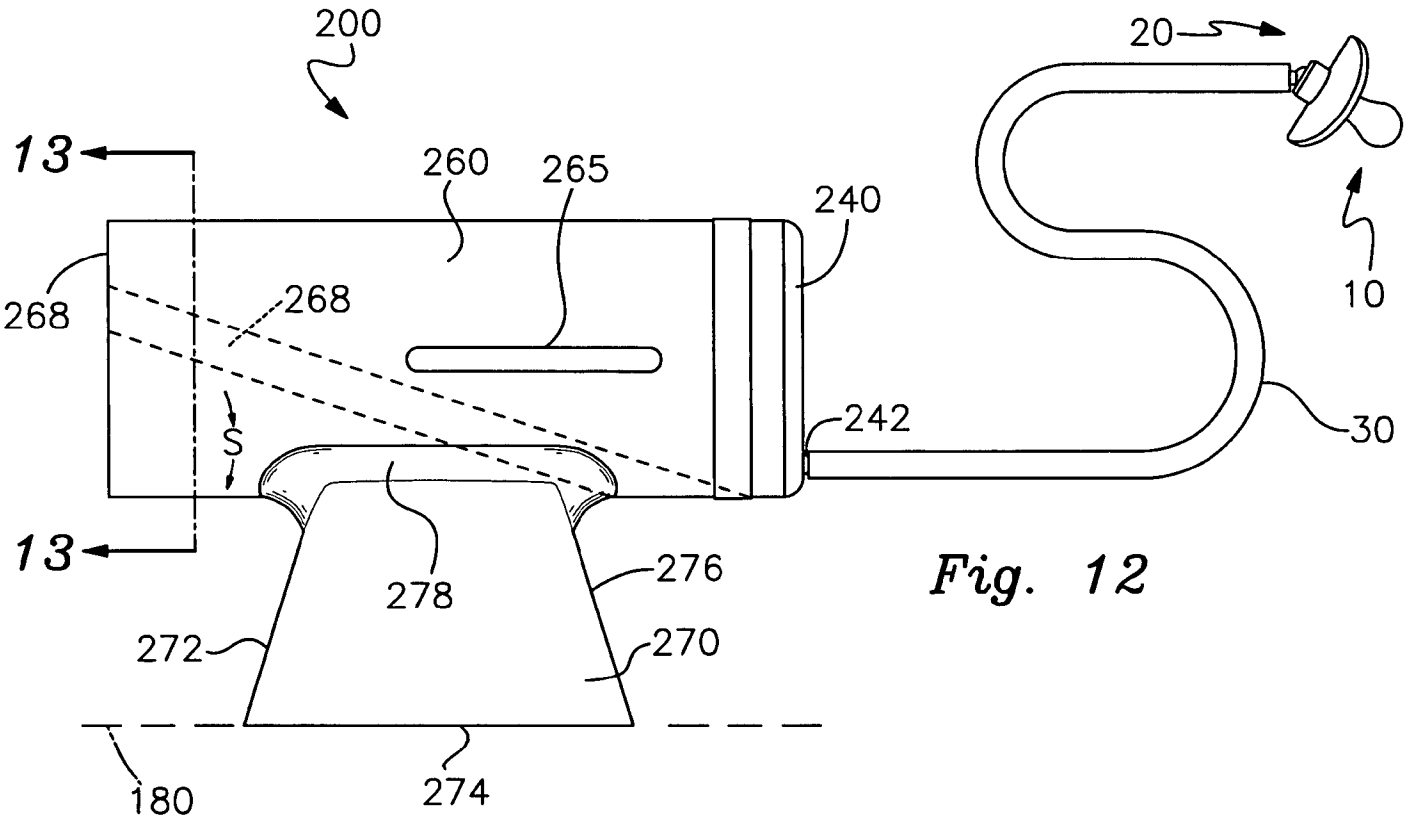
FIG. 12 is a perspective view of a third preferred nursing bottle embodiment with sloped funnel floor inside the bottle and elongated tube connector with swiveling pacifier end.
Figure 13:
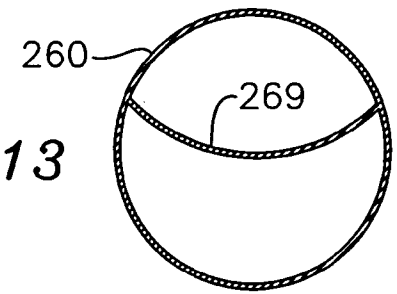
FIG. 13 is a cross-sectional view of the third preferred embodiment of FIG. 12 along arrows 13X.

FIG. 12 is a perspective view of a third preferred nursing bottle embodiment 200 with sloped funnel floor 269 inside the bottle 260 and elongated tube connector 30 with swiveling pacifier end 10, 20. FIG. 13 is a cross-sectional view of the third preferred embodiment 200 of FIG. 12 along arrows 13X. Referring to FIGS. 12–13, third embodiment 200 can have a generally cylindrical bottle 160 resting in a horizontal position on a stand 270. Stand 270 can have back wall 272 and front wall 276 of similar heights so that the bottle 260 remains generally horizontal while the bottom of the stand 274 rests on a support surface 180. The upper surfaces 278 of the stand 270 can have a curved surface for allowing the round contours of the bottle 260 to rest thereon. Stand 270 can be formed from injection molded plastic, and the like, and be pre-formed with bottle 260. Alternatively, stand 270 can be attached to bottle 260 with fasteners such as but not limited to double sided tape, and hook and loop fasteners, and the like. The other components 240, 242, 265 can be identical to the similarly numbered components 140, 142, 165 in the second embodiment.

Inside the bottle 260 can be a sloped floor portion 269 that can have a funnel type shape. Floor 269 can slope downward at an angle S of up to approximately ninety degrees, and preferably forty five degrees. The sloped angle S of the floor surface 269 allows for gravity to assist moving the liquid contents inside the bottle 260 through the tube 30 to a feeding infant.

Additionally, a flexible bag 50 such as those shown and described in the previous embodiments can be used in this embodiment. The rear end 268 of the bottle 260 can be closed. Alternatively, the rear end 268 can be open similar to that of the first embodiment for allowing one to press against an inside bag 50 for assisting the moving of the liquid from the bag 50 through the tube 30. The bottle 260 can be generally cylindrical. Alternatively, the rear end 268 of the bottle 260 can have a flared out sides similar to that of the first embodiment.

While the third embodiment shows one side wall area having a sloped portion, other interior walls within the bottle such as but not limited to all the interior side walls can be sloped. For example, shaping the interior walls like a funnel can be used to assist moving the liquid contents by gravity flow when the bottle is being laid on one side. Still furthermore, shaping the outside walls to be sloped such as but not limited to a triangular portion, a cone shaped portion, and the like can also be used to assist the fluid flow.

Although the preferred embodiments describe applications with a feeding infant the invention can be used with children of varying ages from newborns on up.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An infant bottle feeding apparatus, comprising:

a bottle having an open end and an opposite end;

an elongated feeding tube having one end attached to the open end of the bottle;

a pacifier; and a pivoting means for pivotally attaching the pacifier to the second end of the elongated tube so that the orientation of the pacifier is pivotable relative to the tube for allowing improved access to liquid contents of the bottle to a feeding infant wherein the pivoting means comprises a ball and socket.

2. The apparatus of claim 1, further comprising:

flow assist means for moving the liquid contents through the elongated tube.

3. The apparatus of claim 2, wherein the flow assist means includes:

a flexible bag holding the liquid contents inside the bottle, so that compressing a portion of the flexible bag assists moving the liquid contents through the elongated tube.

4. The apparatus of claim 3, wherein said opposite end is open, wherein a caregiver physically depressing their hand through said opposite end of the bottle depresses the portion of the bag which assists moving the liquid contents through the elongated tube.

5. The apparatus of claim 2, wherein the flow assist means includes:

a stand attached to the bottle for orientating the bottle at a downward angle that allows gravity to assist moving the liquid contents through the elongated tube.

6. The apparatus of claim 5, wherein the stand further includes:

a flat lower base portion for allowing the stand to be supported on a support surface so that the bottle remains at a downward oriented angle.

7. The apparatus of claim 5, wherein the downward angle is up to approximately ninety degrees.

8. The apparatus of claim 7, wherein the downward angle is approximately 45 degrees.

9. The apparatus of claim 2, wherein the flow assist means includes:

an angled interior floor surface inside of the bottle.

10. The apparatus of claim 9, wherein the angled interior floor surface includes a funnel shaped portion.

11. An infant bottle feeding apparatus, comprising:

a bottle having an open end and an opposite end;

an elongated feeding tube having one end attached to the open end of the bottle;

a pacifier;

rotatable pivoting means for pivotally attaching the pacifier to the second end of the elongated tube so that the orientation of the pacifier is pivotable relative to the tube for allowing improved access to the liquid contents by the feeding infant; and a flow assist means directly attached to the bottle for moving liquid contents of the bottle through the feeding tube to the pacifier being used by a feeding infant.

12. The apparatus of claim 11, wherein the flow assist means includes:

a flexible bag holding the liquid contents inside the bottle, so that depressing a portion of the flexible bag through an opening in the bottle assists moving the liquid contents through the elongated tube.

13. The apparatus of claim 11, wherein the flow assist means includes:

a stand attached to the bottle for orientating the bottle at a sloped angle relative a support surface beneath the stand so that gravity assists moving the liquid contents through the elongated tube.

14. The apparatus of claim 11, wherein the flow assist means includes:

a sloped interior surface portion within the bottle for orientating the liquid contents at a sloped angle when the bottle is located generally in a horizontal position on one side so that gravity assists moving the liquid contents through the elongated tube.

* * * * *